US005454558A

United States Patent [19]

Thoma

[11] Patent Number: 5,454,558

[45] Date of Patent: Oct. 3, 1995

[54] SIDE LAY DEVICE

[75] Inventor: Peter Thoma, Mannheim, Germany

[73] Assignee: Heidelberger Druckmaschinen AG, Heidelberg, Germany

[21] Appl. No.: 219,782

[22] Filed: Mar. 30, 1994

[30] Foreign Application Priority Data

Mar. 30, 1993 [DE] Germany ..... 43 10 299.9

[51] Int. Cl.[6] ..... B65H 9/16

[52] U.S. Cl. ..... 271/248; 271/253

[58] Field of Search ..... 271/240, 248, 271/250, 252, 253, 254, 255; 226/199

[56] References Cited

U.S. PATENT DOCUMENTS

| | | | |
|---|---|---|---|
| 4,428,521 | 1/1984 | Rich et al. | 226/199 |
| 4,533,134 | 8/1985 | Galster | 271/240 |
| 4,750,660 | 6/1988 | Kamimura | 271/240 |
| 4,844,441 | 7/1989 | Motohashi | 271/253 |
| 4,846,387 | 7/1989 | Mano | 226/199 |
| 4,917,370 | 4/1990 | Batts | 271/240 |
| 5,098,081 | 3/1992 | DeFigueiredo | 271/240 |
| 5,299,799 | 4/1994 | Filsinger et al. | 271/250 |
| 5,308,057 | 5/1994 | Thoma | 271/248 |

*Primary Examiner*—H. Grant Skaggs
*Attorney, Agent, or Firm*—Herbert L. Lerner; Laurence A. Greenberg

[57] ABSTRACT

A side lay device on a feeder table of a sheet-processing machine includes at least one side lay body mounted so as to be displaceable over a path transverse to a sheet conveying direction for adjusting to a selected format of the sheet, a device for displacing the side lay body, first surface elements durably fastened to the side lay body parallel to the displacement direction of the side lay body, second mutually parallel surface elements fixed to the sheet-processing machine and corresponding to the first surface elements, the second surface elements extending over the entire adjustment path of the side lay body, at least one group of the groups consisting of the first surface elements, regions of the second surface elements in vicinity of the side lay body, and both the first surface elements and the regions of the second surface elements located in the position of the side lay bodies being movable towards one another for producing friction contact between the first and the second surface elements, and a device for moving the first surface elements and the second surface elements in a direction relatively towards and away from one another and for applying a normal force between the first surface elements and the second surface elements for producing and releasing the friction contact.

7 Claims, 5 Drawing Sheets

SIDE LAY DEVICE

SPECIFICATION

Figure 1:
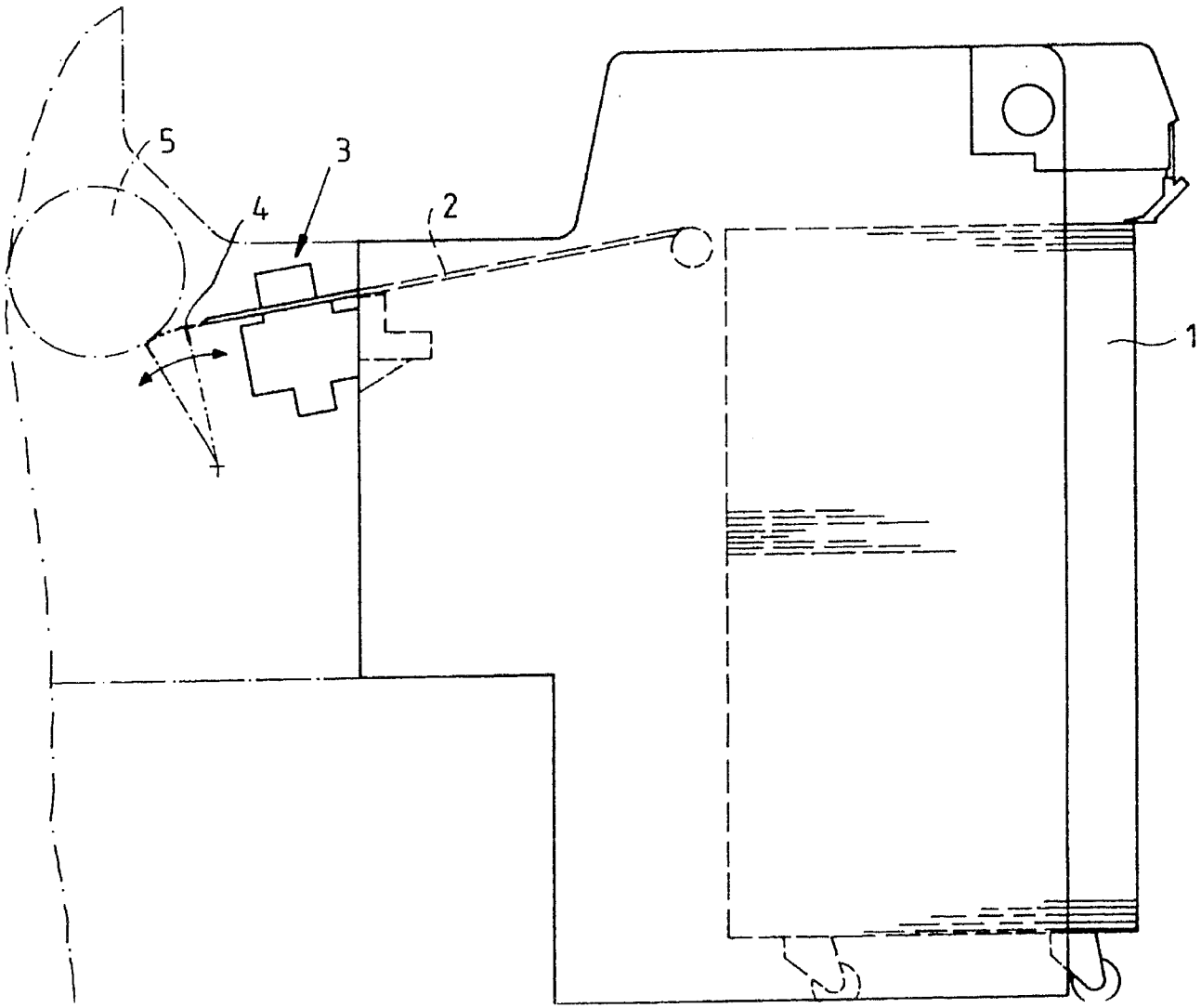

The invention relates to a side lay device and, more particularly, to a side lay device located on a feeder table of a paper sheet-processing machine, such as a printing press.

It has become known heretofore to displace side lay devices transversely to a sheet conveying direction for the purpose of setting a sheet-processing machine to a desired sheet format and to arrest or lock the side lay devices in the desired position. In this regard, it has become known to shift the body of the respective side lay on shafts which are aligned transversely to the sheet conveying direction and, then, to fix the side lay device in the desired position, for example, by means of a capstan-head screw. When thus fixing the side lay device, a pin body of the capstan-head screw, which is set for displacement of the side lay device so that a flattened part of the cylindrical surface of the pin body is aligned parallel to one of the setting shafts, is usually turned or twisted out of this parallel alignment. Because the axial spacing between the axis of the capstand-head screw and the setting or adjusting shaft is selected so that it is smaller than the sum of the radii of the setting shaft and the cylindrical capstan-head screw, the edge of the casing surface between the flattened part and the cylindrical casing region of the capstan-head screw is pressed against the casing surface. This application of linear pressure along the edge permits clamping between the side lay body and the displacement shaft. Due to this linear pressing action, however, the danger arises of producing lasting impressions in the displacement shaft so that, after frequent use, a reliable format setting is no longer assured. Due to fretting corrosion or galling, a danger exists, moreover, that the manually operated or manipulated capstan-head screw may be loosened only with great difficulty by the operator or pressman, if loosened at all. Automatic adjustments of such locking devices with capstan-head screws operated or acted upon from above are conceivable only with a very great additional expense or effort. Due to the lasting impressions, it is difficult, after frequent use, to assure an exact, reproducible format setting.

It is, accordingly, an object of the invention to provide a side lay device which, by relatively simple means, rapidly achieves a reliable, reproducible format setting.

With the foregoing and other objects in view, there is provided, in accordance with the invention, on a feeder table of a sheet-processing machine, a side lay device comprising at least one side lay body mounted so as to be displaceable over a path transverse to a sheet conveying direction for adjusting to a selected format of the sheet, means for displacing the side lay body, first surface elements durably fastened to the side lay body parallel to the displacement direction of the side lay body, second mutually parallel surface elements fixed to the sheet-processing machine and corresponding to the first surface elements, the second surface elements extending over the entire adjustment path of the side lay body, at least one group of the groups consisting of the first surface elements, regions of the second surface elements in vicinity of the side lay body, and both the first surface elements and the regions of the second surface elements located in the position of the side lay bodies being movable towards one another for producing friction contact between the first and the second surface elements, and means for moving the first surface elements and the second surface elements in a direction relatively towards and away from one another and for applying a normal force between the first surface elements and the second surface elements for producing and releasing the friction contact.

The durable parallel surface elements may be brought by relatively simple relative movement towards one another initially into sliding friction contact and by a normal force into static-friction contact. Due to the surface or contact pressure arising therefrom, a considerably better force distribution is produced. Lasting impressions can be avoided to the greatest extent. The clamping action can be readily released. By adjusting or setting the side lay body, the surface elements on the side lay body are shifted with the side lay body while the parallelism with the surface elements fixed to the sheet-processing machine is maintained. Through the expansion thereof over the entire displacement width of the side lay, a locking of the latter in every desired position can be effected simply and reliably. Also, after frequent use, a reproducible format adjustment or setting of a side lay device is reliably assured.

In accordance with another feature of the invention, the moving direction of the first surface elements and the second surface elements is substantially the direction of application of the normal force. For this purpose, the same means for producing the movement for applying the normal force can be used. A relatively simple, reliable and rapid adjustment is additionally promoted thereby. The use of several parallel surface elements permits a space-saving reliable adjustment or setting.

In accordance with a further feature of the invention, all of the first surface elements and all of the the second surface elements are, respectively, disposed in a multiple platelike arrangement corresponding to one another, both of the multiple platelike arrangements being disposed so that the multiple platelike surface elements of the arrangement fixed to the sheet-processing machine engage friction-free in the arrangement on the side lay body, the moving means including means for applying the normal force for pressing together the mutually engaging multiple platelike arrangements perpendicularly to the surfaces of the surface elements thereof for producing friction contact between the individual plate-like surface elements.

In accordance with an added feature of the invention, the means for applying the normal force comprises a common adjusting device for generating the normal force between all of the mutually adjacent and engaging surface elements of both of the multiple platelike arrangements.

In accordance with an additional feature of the invention, both the first and the second surface elements are formed as bending plates clamped at one side thereof, and including means for applying the normal force on the bending plates at a bending region thereof other than the clamped region.

In accordance with yet another feature of the invention, the means for applying the normal force comprises an adjustment device formed as a pneumatic cylinder. Therewith, relatively large holding forces for producing the locking of the side lay bodies are capable of being applied relatively simply on a small space. A common adjusting means for locking all of the surface elements of both arrangements is relatively inexpensive and especially reliable in operation. A pneumatic cylinder affords good remote control.

In accordance with a concomitant feature of the invention, on a feeder table of a sheet-processing machine, there are provided, a side lay located on a drive side of the sheet-processing machine, and a side lay located on an operator side of the sheet-processing machine, and common adjustment means are included for locking both of the side lays. Because it is relatively simple, inexpensive and readily controllable, the use of such a common adjustment means is preferred.

Other features which are considered as characteristic for the invention are set forth in the appended claims.

Although the invention is illustrated and described herein as embodied in side-lay device, it is nevertheless not intended to be limited to the details shown, since various modifications and structural changes may be made therein without departing from the spirit of the invention and within the scope and range of equivalents of the claims.

Figure 2A:
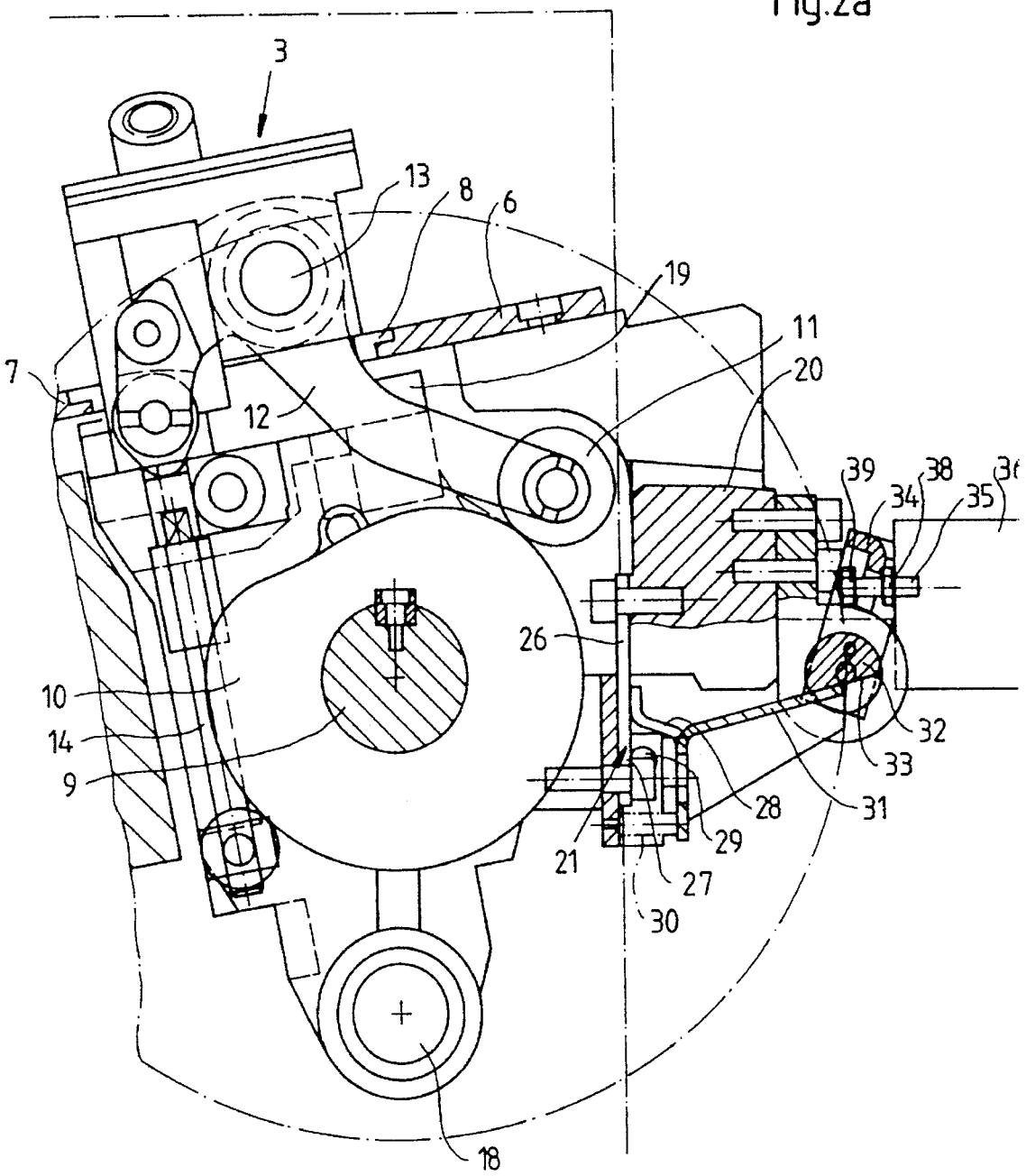
Figure 2B:
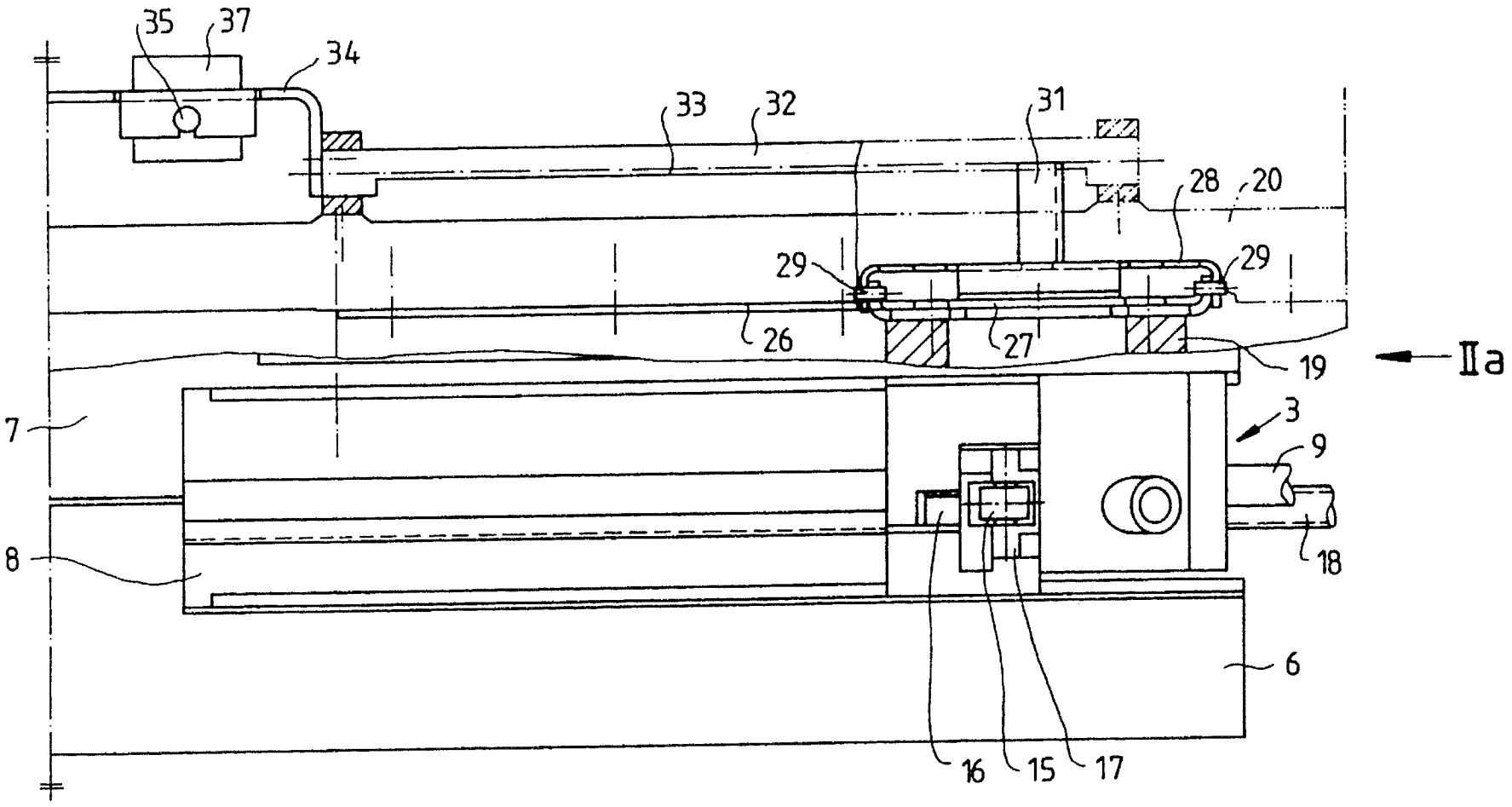
Figure 3:
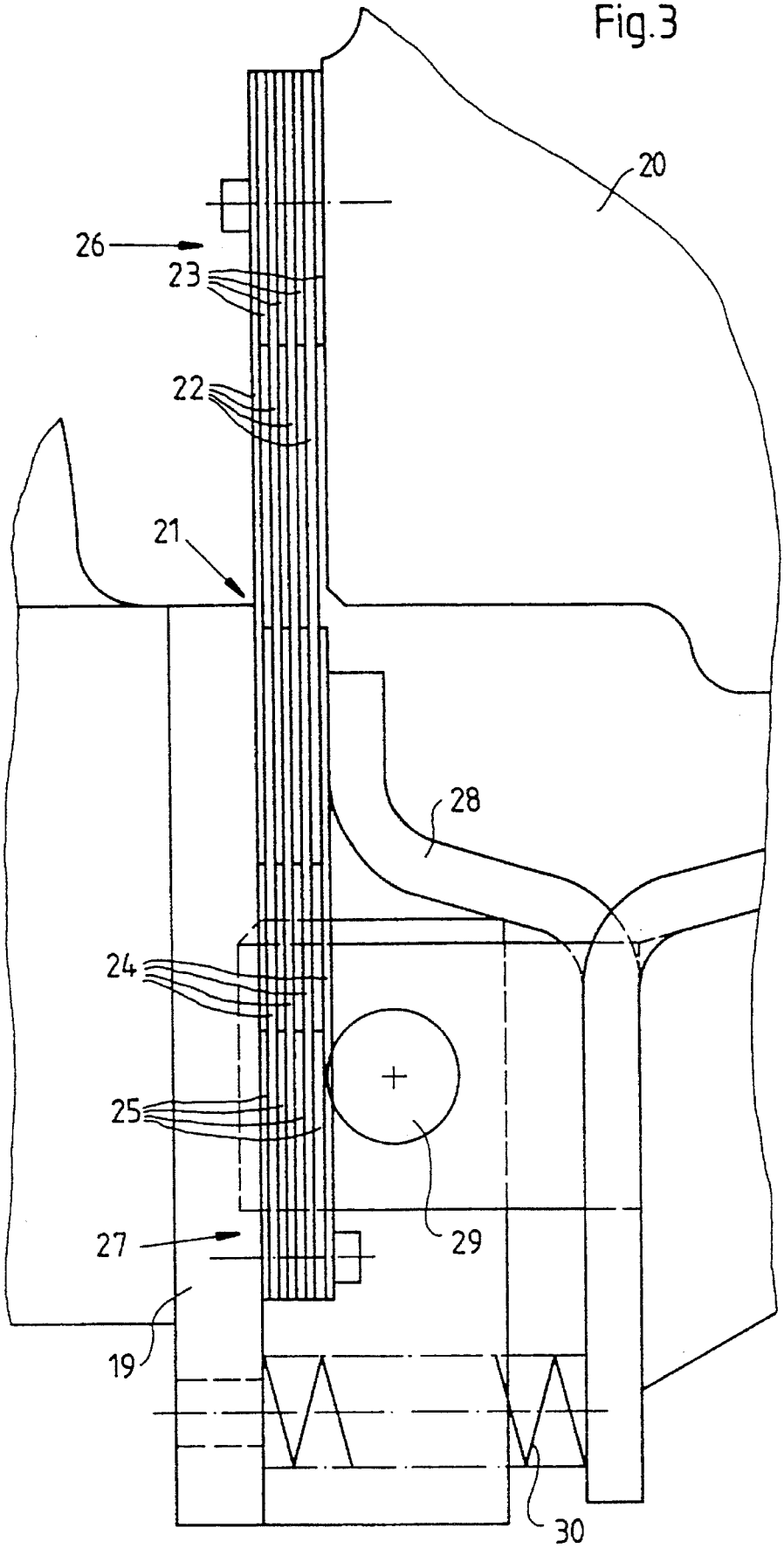
Figure 4A:
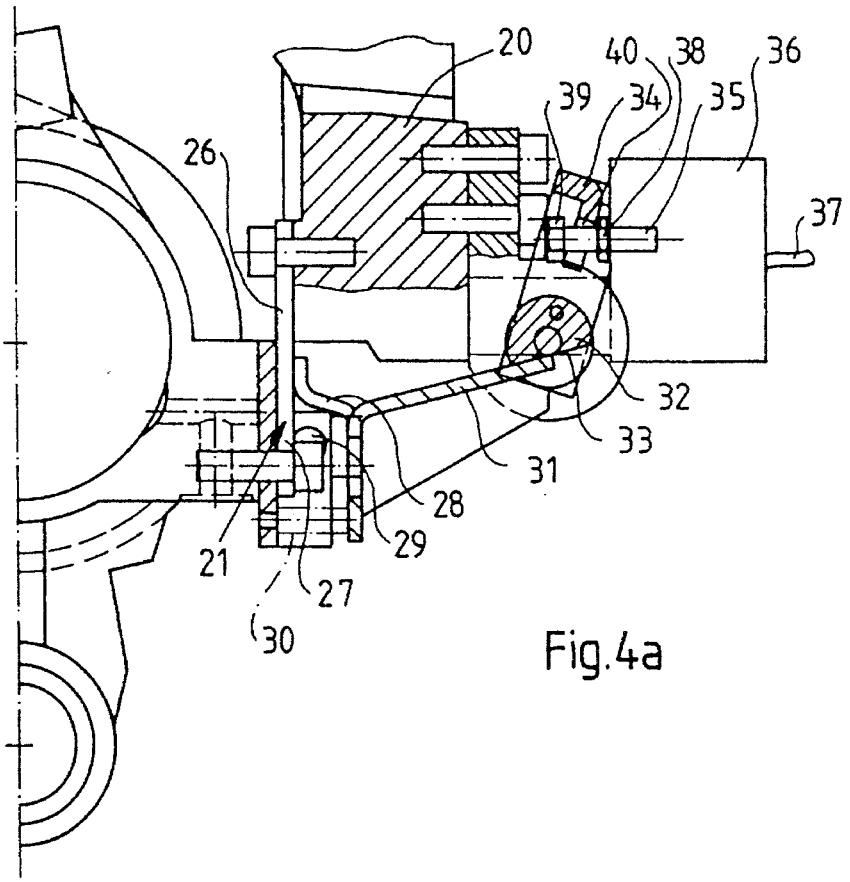
Figure 4B:
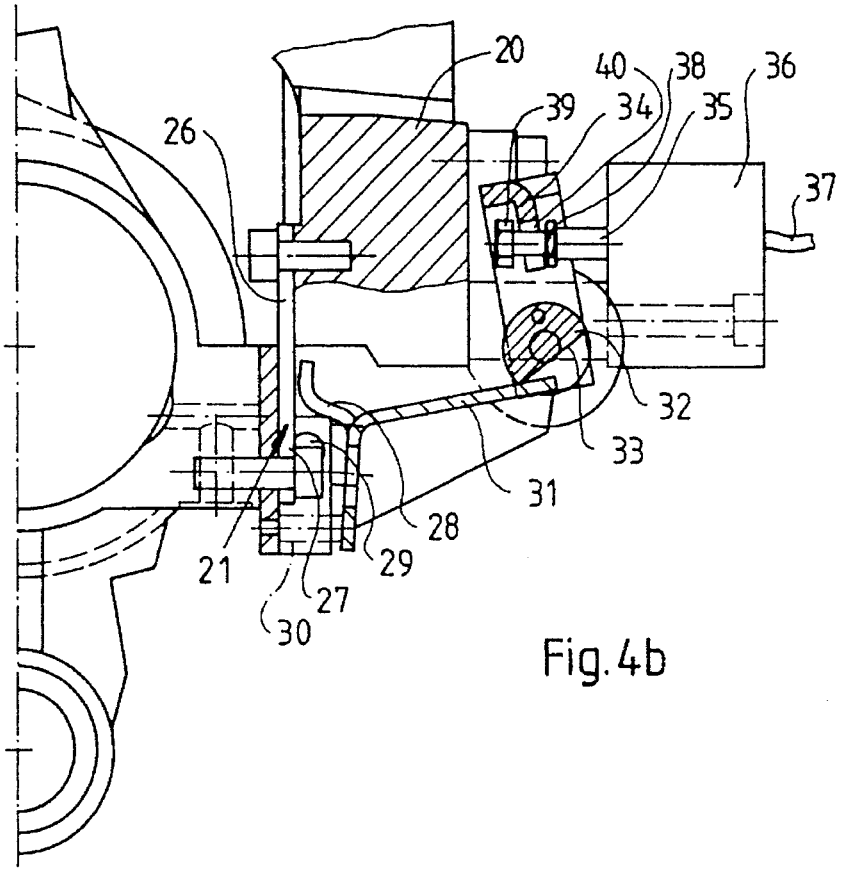

The construction and method of operation of the invention, however, together with additional objects and advantages thereof will be best understood from the following description of specific embodiments when read in connection with the accompanying drawings, in which:

FIG. 1 is a fragmentary, diagrammatic side elevational view of a sheet-fed rotary printing press wherein a side lay device is disposed in a feeder region thereof;

FIG. 2*a* is an enlarged fragmentary end view, partly in cross section, of a side lay with a multiple-plate clamping device forming part of the invention shown in FIG. 1;

FIG. 2*b* is a slightly reduced side elevational view of the side lay with the multiple-plate clamping device, wherein the end view thereof shown in FIG. 2*a* is seen in the direction of the arrow IIa and is rotated approximately 45° counterclockwise therefrom;

FIG. 3 is a much-enlarged fragmentary view of FIG. 2*a* showing the multiple-plate clamping device in greater detail; and FIGS. 4*a* and 4*b* are fragmentary views of FIG. 2*a* showing the side lay device of the invention in two different phases of operation and serving to explain the clamping and releasing actions thereof.

Referring now to the figures of the drawings and, first, particularly to FIG. 1 thereof, there is shown therein a sheet feeder of a sheet-fed rotary printing press, wherein a paper sheet is conveyed in a conventional manner from a feed pile 1 via a feeding table 2 to an oscillating pregripper 4, from which, after the alignment of the paper sheet at non-illustrated front lays and by a side lay device 3 on the feeding table 2, it is taken over and transferred to a following cylinder 5 of an otherwise non-illustrated printing unit of the printing press.

The side lay device 3 is formed with a body 19 (note FIGS. 2*a*, 2*b* and 3) by which it is rotatably mounted, in a conventional manner, in non-illustrated side walls of the printing press transversely to the sheet conveying direction, and displaceably supported on a control shaft 9 connected to the drive system of the printing press. As shown in FIGS. 2*a* and 2*b*, a cam 10 is displaceably supported with the side lay body 19 on the control shaft 9 and, by means of a spring 14 of a spring rod or pole, is disposed in continuous contact engagement with a lever 17 on which a roller 15 is rotatably mounted, the roller 15 being moved cyclically back and forth by the cam 10. A sheet conveying plane is located between the roller 15 and a draw bar 16 disposed therebelow in the plane of the table. Due to the cyclic rocking or swinging away of the roller 15, the respective sheet located between the roller 15 and the draw bar 16 is pressed towards the draw bar 16 and can be drawn by the latter, in a conventional manner, transversely to the sheet conveying plane against a non-illustrated side edge stop located in the side lay body 19 and extending into the sheet conveying plane. The paper sheet is thereby aligned along the sheet side edge thereof.

Due to the swinging back of the roller 15, the sheet is released for further conveyance thereof.

To set the side lay device 3 to a desired width of the format of a particular paper sheet, a spindle 18 is arranged, in a conventional manner, below the plane of the feeder table transversely to the sheet conveying direction, and is connected to non-illustrated drive means. The spindle 18 is screwed into a thread of respective complementary appearance formed in the side lay body 19. By turning the spindle 18, with a displacement of the side lay body 19 and of the cam 10 on the control shaft 9, the side lay device 3 can be adjusted into the desired position transversely to the sheet conveying direction, within a displacement gap 8 extending transversely to the sheet conveying direction and located between a table plate 7 arranged at an upstream location of the sheet conveying direction of the side lay device 3 and a table plate 6 located downstream therefrom in the sheet conveying direction of the side lay device 3. The gap 8 between the table plates 7 and 6 can then be covered in a conventional non-illustrated manner, for example, by means of table plate elements, to produce a closed table cover. A tie rod 20 is fastened in the side frames of the printing press aligned transversely to the sheet conveying direction and disposed at an upstream location in the sheet conveying direction of the side lay device. A multiple-plate coupling or clutch 21 is disposed between the tie rod 20 and the side lay body 19 and is formed of an upper multiple-plate set 26, as viewed in FIG. 3, which is fastened to the tie rod 20 and extends transversely to the sheet conveying direction over the entire adjustment range of the side lay, and a lower multiple-plate set 27, which is fastened to the side lay body 19 and extends over the width of the side lay body 19.

As shown in FIG. 3, the upper multiple-plate set 26 is formed of a row of like-size plates 22 having a downwardly extending very long side, and in exchange or alternating therewith, respectively, intermediately arranged like-size but shorter plates 23. A multiple-plate set 26 is thereby formed wherein the very long plates extend downwardly quite far, and the shorter plates 23 function as spacer supports. Between the very long plates 22 there extend correspondingly formed very long plates 24 of the lower multiple-plate set 27 fastened to the side lay body 19 and, between the very long plates 24 of the lower set 27, shorter plates 25 of like size are arranged as spacer supports. The plates 24 and 25 are also connected in alternating manner into the multiple-plate set 27 and fastened to the side lay body 19. The corresponding sides of the individual plates 22 and 24 facing towards one another are disposed in mutual sliding contact engagement.

A lever 28 is mounted on the side lay body 19 so as to be swivellable about a swivel shaft 29 and so as to be pressed by a compression spring 30 in continuous contact engagement with the side of the multiple-plate coupling 21 formed from the multiple-plate sets 26 and 27 facing away from the side lay body 19. The lever 28 presses the plates 24 and 22 with the mutually adjacent surfaces thereof against one another with a normal force, so that the mutually adjacent surfaces of the plates 22 and 24 are in static-frictional contact in the intersection region of the plates 22 and 24. A lever arm 31 of the lever 28 extends under a flat region 33 of a swivel shaft 32. The lever arm 31 is disposed substantially parallel to the flat region 33 and slightly spaced therefrom, and is spaced a distance from the swivel shaft 32 which is smaller than the radius of the swivel shaft 32. The swivel shaft 32, which is rotatably mounted in the tie rod 20, extends transversely to the sheet conveying direction. A lever 34 is fastened to this swivel shaft 32 and is formed with an opening 40 in which a piston rod 35 of a pneumatic cylinder 36 engages.

During the conveyance of the sheet, the lever 28 remains in continuous pressing contact engagement with the multiple-plate clutch 21. Due to the normal force exerted thereby on the multiple plates 22 and 24 and the static friction produced thereby between the mutually adjacent plates, and as a result of a large friction surface formed by summing or adding the mutually engaging surfaces of the plates 22 and 24, the side lay device is firmly locked in the position thereof with high static friction transversely to the sheet conveying direction. For adjusting or setting the side lay, the pneumatic cylinder 36 is controlled in a conventional manner via a feed line 37 supplied with air. The pneumatic piston 35 is thereby shifted from the position thereof shown in FIG. 4*a* to the position thereof shown in FIG. 4*b*. By means of a stop nut 38 on the pneumatic piston 35, the lever 34 is swung out of the position thereof shown in FIG. 4*a* counter-clockwise into the position thereof shown in FIG. 4*b*. The flat region 33 of the control shaft 32 thus swivels about the axis of the control shaft 32, and the lever arm 31 of the lever 28 is thereby swiveled downwardly. The lever 28 is thereby released clockwise against the force of the spring 30 out of the position of engagement thereof with the multiple plates. Due to the natural or characteristic resilience or springiness of the plates 22 and 24, the mutually adjacent plates 22 and 24 pass from static friction into sliding friction. By means of the spindle 18, the side lay 3 can then be adjusted in the position thereof. In the desired position, the pneumatic cylinder 36 can again be vented, so that the piston rod 35 is moved again into the position thereof shown in FIG. 4*a*. By means of the stop nut 39, the lever 34 is swivelled again into the original position thereof shown in FIG. 4*a*. The lever 28 is again pressed by the spring 30 against the multiple-plate set for producing the locking static friction.

By means of the nuts 38 and 39, the swivel path can be precisely set.

In FIG. 2*b*, only one side of the printing press and, accordingly, one side lay device 3 are shown. It is clearly also conceivable that, as a mirror image to the middle of the table, another side lay device for the other side of the sheet may be provided in a conventional manner. Another swivel shaft 32 with a flat region 33 formed thereon can thus be swivellably fastened to the lever 34 on the other side of the table, and can serve for controlling the multiple-plate coupling or clutch of the second side lay via another lever arm 31 of another lever 28. It is also possible to release both of the side lays from the locked condition thereof and to restore them to the locked condition thereof by means of only one pneumatic cylinder 37. Thus, both a side lay device on the drive side as well as on the operator side of the printing press may be rapidly and reliably locked and again released.

I claim:

1. On a feeder table of a sheet-processing machine, a side lay device comprising at least one side lay body mounted so as to be displaceable over an adjustment path in a displacement direction transverse to a sheet conveying direction for adjusting to a selected format of the sheet, means for displacing the side lay body, first surface elements durably fastened to the side lay body parallel to the displacement direction of the side lay body, second mutually parallel surface elements fixed to the sheet-processing machine and corresponding to said first surface elements, said second surface elements extending over the entire adjustment path of said side lay body, at least one group of the groups defined by a) said first surface elements, b) regions of said second surface elements in vicinity of said side lay body, and c) both said first surface elements and said regions of said second surface elements located in the position of said side lay bodies, being movable towards one another for producing friction contact between said first and said second surface elements, and means for moving said first surface elements and said second surface elements in a direction relatively towards and away from one another and for applying a normal component of force between said first surface elements and said second surface elements for producing and releasing said friction contact.

2. Side lay device according to claim 1, wherein said moving direction of said first surface elements and said second surface elements is substantially the direction of application of said normal component of force.

3. Side lay device according to claim 1, wherein all of said first surface elements and all of said said second surface elements are, respectively, disposed in a multiple platelike arrangement corresponding to one another, both of said multiple platelike arrangements being disposed so that the multiple platelike surface elements of the arrangement fixed to the sheet-processing machine engage in sliding contact with the arrangement on said side lay body, said moving means including means for applying the normal component of force for pressing together the mutually engaging multiple platelike arrangements perpendicularly to the surfaces of said surface elements thereof for producing friction contact between the individual plate-like surface elements.

4. Side lay device according to claim 3, wherein said means for applying the normal component of force comprises a common adjusting device for generating the normal force between all of the mutually adjacent and engaging surface elements of both of said multiple platelike arrangements.

5. Side lay device according to claim 1, wherein both said first and said second surface elements are formed as bending plates clamped at one side thereof, and including means for applying the normal component force on said bending plates at a bending region thereof other than the clamped region.

6. Side lay device according to claim 1, wherein said means for applying the normal component of force comprises an adjustment device formed as a pneumatic cylinder.

7. On a feeder table of a sheet-processing machine according to claim 1, a side lay located on a drive side of the sheet-processing machine, and a side lay located on an operator side of the sheet-processing machine, and including common adjustment means for locking both of said side lays.

* * * * *